US007563111B2

(12) United States Patent
Kinoshita et al.

(10) Patent No.: US 7,563,111 B2
(45) Date of Patent: Jul. 21, 2009

(54) BOARD CONNECTOR

(75) Inventors: Kousuke Kinoshita, Kosai (JP); Koki Sato, Kosai (JP)

(73) Assignee: Yazaki Corporation, Tokyo (JP)

( * ) Notice: Subject to any disclaimer, the term of this patent is extended or adjusted under 35 U.S.C. 154(b) by 141 days.

(21) Appl. No.: 11/745,479

(22) Filed: May 8, 2007

(65) Prior Publication Data

US 2007/0264847 A1 Nov. 15, 2007

(30) Foreign Application Priority Data

May 9, 2006 (JP) ..... 2006-130377

(51) Int. Cl.
*H01R 12/00* (2006.01)

(52) U.S. Cl. ..... 439/79

(58) Field of Classification Search ..... 439/79
See application file for complete search history.

(56) References Cited

U.S. PATENT DOCUMENTS 6,702,620 B2 3/2004 Lynch et al.
2003/0027443 A1* 2/2003 Sasaki ..... 439/79
2003/0194889 A1* 10/2003 Golat et al. ..... 439/79

FOREIGN PATENT DOCUMENTS

| | | | |
|---|---|---|---|
| DE | 10319249 | A1 | 12/2004 |
| EP | 1345287 | A1 | 9/2003 |
| JP | 2001-283977 | A | 10/2001 |
| JP | 2005-123120 | A | 5/2005 |
| WO | 2005/043693 | A1 | 5/2005 |

OTHER PUBLICATIONS

Chinese Office Action dated Nov. 14, 2008.
German Office Action dated Jan. 30, 2009.

* cited by examiner

*Primary Examiner*—Gary F. Paumen
(74) *Attorney, Agent, or Firm*—Sughrue Mion, PLLC

(57) ABSTRACT

In a board connector including: a connector housing; and at least two types of terminals having different sizes and held in the connector housing, such that said at least two types of terminals are arranged in parallel with one another in the connector housing and projects from a rear wall of the connector housing so as to be bent downwardly to form L-shape, wherein a plurality of block, each of which is formed by a group of said at least two types of terminals, are arranged in a horizontal direction, and said two types of terminals are divided in a vertical direction in accordance with the size of the terminals in each block.

3 Claims, 3 Drawing Sheets

BOARD CONNECTOR

BACKGROUND OF THE INVENTION

1. Field of the Invention

This invention relates to a board connector which is used by mounting on a printed circuit board (PCB) accommodated in an electric junction block for an automobile, for example.

2. Related Art

In the board connector, in general, terminals are mounted by penetrating the connector housing having a hood portion such that connection ends of the terminals to mating connector terminals project into the hood portion and the other connection ends of the terminals to the PCB project on the opposite side of the hood portion and are bent in L-shape (see, for example, JP-A2005-123120 Publication).

The connector housing supplies a function to hold the terminals, a function to hold a fitting state to the mating connector, and a function to fix the connector to the board. The terminals supply a function to electrically connect the mating terminals, a function to fix the connector to the board by being soldered to the board, and a function to electrically connect circuits on the board.

As such a board connector, there is known a board connector in which a plurality of terminals having different sizes are arranged in one connector housing. For example, in a board connector which is mounted to a PCB for an electric junction lock (or, electric connection box) of an automobile, thick terminals of power supply system for connecting with a battery and thin terminals of distribution system for distributing the power are arranged in one connector housing by dividing these terminals into groups.

FIG. 6 shows one example of the above-mentioned board connector.

In the board connector 110 as shown in this figure, a connector housing 111 is horizontally divided into several spaces F1, F2, F3 and a group of thick terminals 21 is arranged in the space F1 and groups of thin terminals 22 are arranged into the spaces F2, F3. In other words, the terminals 21,22 are grouped in accordance with their sizes.

However, as described above, when the terminals 21,22 are grouped in accordance with their sizes, a lot of void spaces may be formed in the connector housing 110 in some combinations of the terminals, and the total size of the connector 110 may become large. In addition, since the terminals 21,22 having different sizes are arranged in the same level in the connector housing, the arrangement balance of the conductor pattern becomes undesirable on the PCB to which the board connector is mounted.

SUMMARY OF THE INVENTION

The present invention has been made in view of the above circumstances, and an object of the invention is to provide a board connector which is downsized and is improved in a terminal density and a wiring availability to a conductive pattern on the PCB side.

To achieve the above object, the board connector according to the present invention is characterized as follows (1) and (2).

(1) A board connector includes:

a connector housing; and at least two types of terminals having different sizes and held in the connector housing, such that said at least two types of terminals are arranged in parallel with one another in the connector housing and projects from a rear wall of the connector housing so as to be bent downwardly to form L-shape, wherein a plurality of block, each of which is formed by a group of said at least two types of terminals, are arranged in a horizontal direction, and said two types of terminals are divided in a vertical direction in accordance with the size of the terminals in each block.

(2) A board connector according to the above (1), wherein the terminals having a thick-size, which are a first one of said at least two types of terminals, are arranged on an upper side of the block, and the terminals having a thin-size, which are a second one of said at least two types of terminals, are arranged on a lower side of the block, and the terminals having the thick-size are bent downwardly so as to form t-shape at an outer position further from the connector housing than an inner position at which the terminals having the thin-size are bent.

According to the board connector described in the above (1), since a block as one unit is formed by a group of the plurality of terminals having different sizes, and a plurality of the blocks are arranged in the horizontal direction, void spaces can be reduced, so that the terminal density is increased and the board connector is downsized. Further, since the plurality of terminals are disposed so as to be divided in the vertical direction in accordance with the size of the terminals in each block, the wiring availability to the conductor pattern on the PCB can be improved.

Further, according to the board connector described in the above (2), in each block, since the terminals having a thick-size are arranged on the upper side of the block, and the terminals having a thin-size are arranged on the lower side of the block. Further, the terminals having the thick-size, projecting from the rear wall of the connector housing, are bent downwardly so as to form L-shape at an outer position further from the connector housing than an inner position at which the terminals having the thin-size, projecting from the rear wall of the connector housing are bent downwardly so as to form L-shape, the following advantages are obtained when the board connector is mounted to an end portion of the PCB. Namely, according to the board connector as described in the above (2), thick conductor patterns which are connected to the terminals having the thick-size are located on an inner side with respect to the connector housing. Further, according to the board connector as described in the above (2), thin conductor patterns which are connected to the terminal having the thin-size are located on an outer side with respect to the connector housing Accordingly, the board connector as described in the above (2) provides a good wiring availability. Furthermore, since the terminals having the thick-size on the upper side of the block are bent at the outer position with large dimension, the lengths of the terminals are increased. Therefore, heat radiation property from the terminals can be improved in the board connector as described in the above (2). Furthermore, according to the board connector as described in the above (2), even though comparatively large force can be applied to the terminals having the thick-size when the board connector when the mating connector are connected or disconnected with each other, the terminals can be more flexible by increasing the terminal length and the distance between both fixing ends (one end is fixed to the connector housing and the other end is fixed to the board) As a result, it is possible to avoid applying excessive force to the connection portion with the board.

In the present invention, there can be provided a board connector which is downsized, increasing a terminal density and a wiring availability to a conductive pattern on the PCB side.

The invention has been briefly described above. Details of the invention will become more manifest upon reading the following Section "DETAILED DESCRIPTION OF THE PREFERRED EMBODIMENTS" with reference to the accompanying drawings.

DETAILED DESCRIPTION OF THE PREFERRED EMBODIMENTS

A preferred embodiment of the present invention will now be described in detail with reference to FIGS. 1 to 6.

Figure 1:
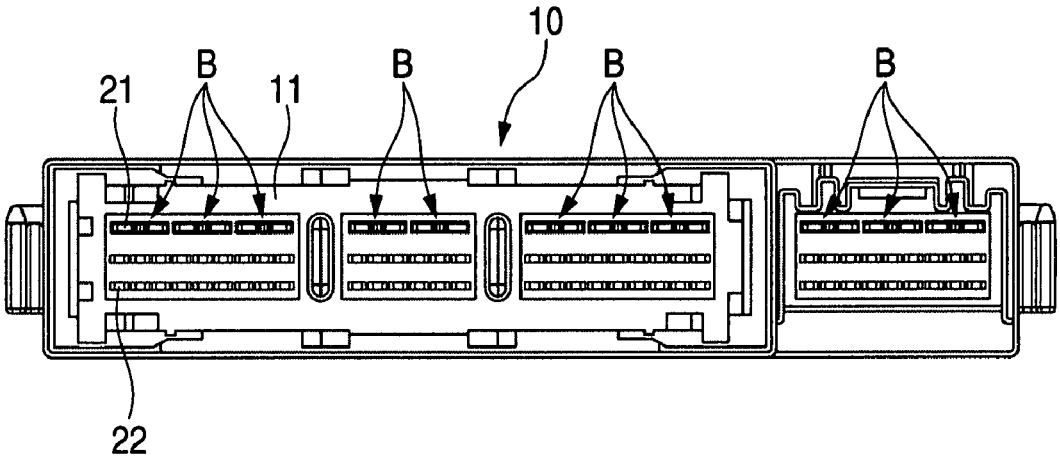
FIG. 1 is a front view showing a board connector according to an embodiment of the invention.
Figure 2:
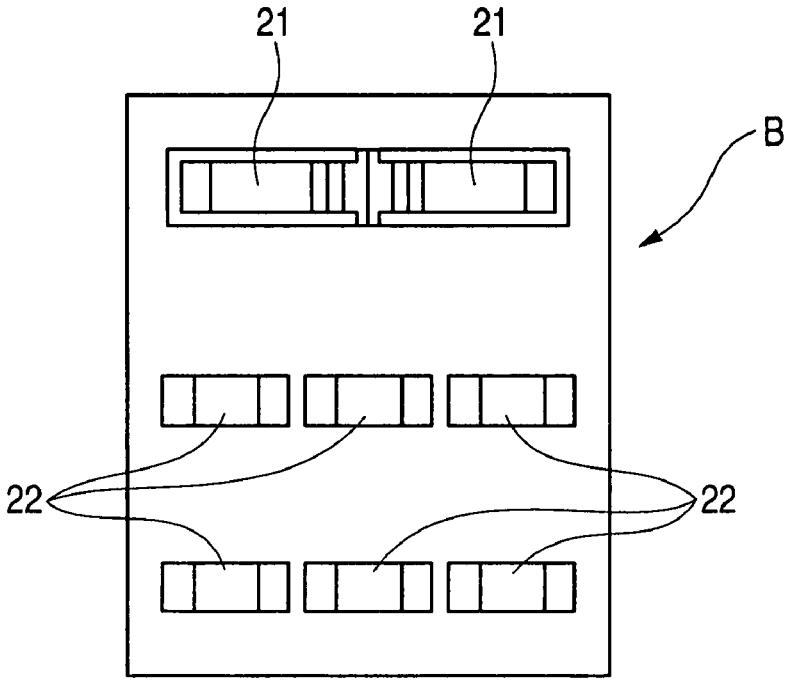
FIG. 2 is an explanatory view of a block formed by a set of terminals having different sizes.
Figure 3:
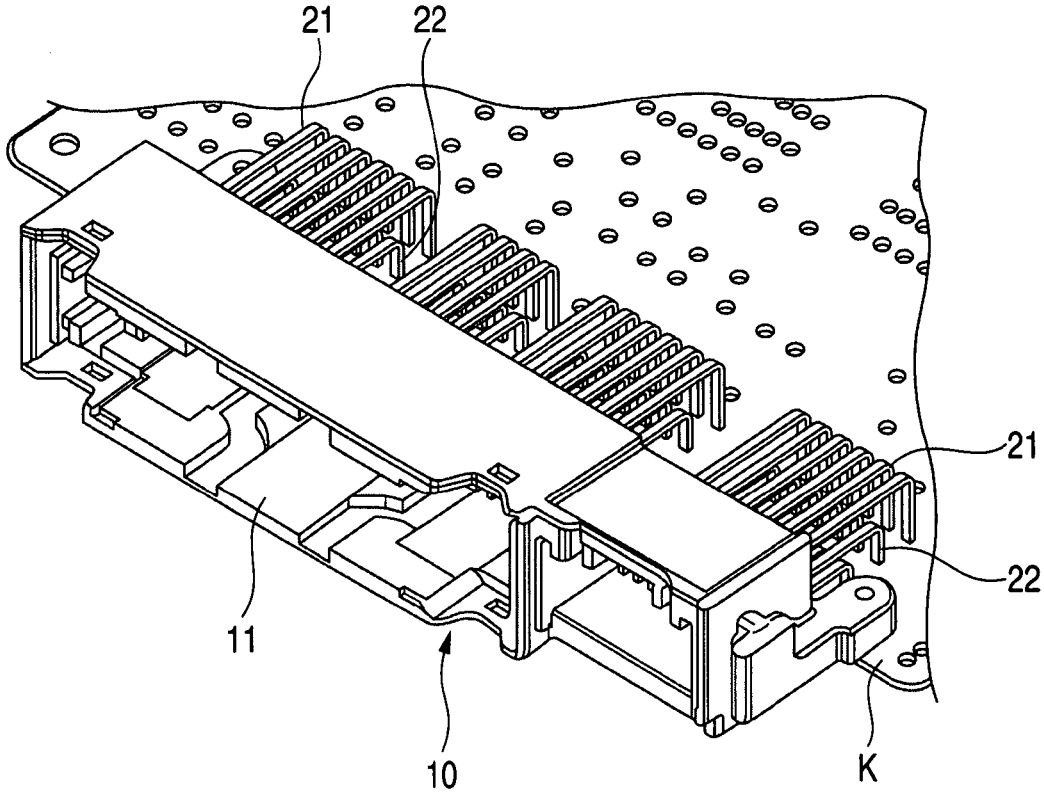
FIG. 3 is a perspective view showing a mounting state of the board connector to a printed circuit board.
Figure 4:
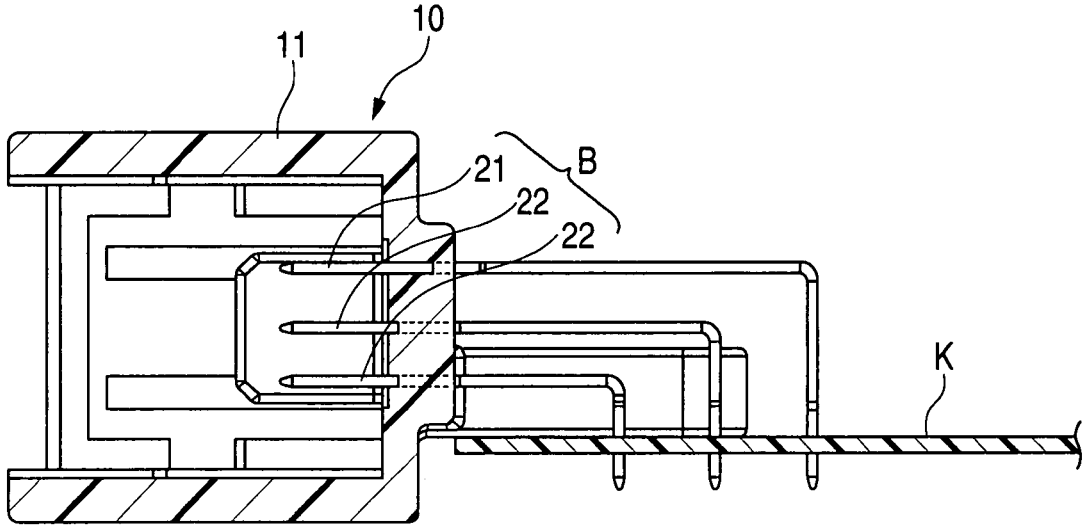
FIG. 4 is a longitudinal sectional view showing the mounting state of the board connector to the printed circuit board.

FIG. 1 is a front view showing a board connector according to an embodiment of the invention, FIG. 2 is an explanatory view of a block formed by a set of terminals having different sizes, FIG. 3 is a perspective view showing a mounting state of the board connector to a printed circuit board, FIG. 4 is a longitudinal sectional view showing the mounting state of the board connector to the printed circuit board.

As shown in FIGS. 1 and 3, a board connector 10 is configured by arranging a multiple of two types of terminals 21,22 having two different sizes in one connector housing 11 based on a predetermined design rule. The terminals 21,22 are arranged in parallel with each other in the connector housing 11, and the projecting portions of the terminals 21,22 projecting from a rear wall of the connector housing 11 are bent downwardly so as to form L-shape while being kept in parallel with each other. Tip end portions of the terminals 21,22 that are bent are soldered to conductor patterns on a board K to mount the board connector 10 on the board K.

In this embodiment, as shown in FIG. 2, a group consisting of the terminals 21,22 having two different sizes forms a block B as one arrangement unit, and a plurality of the blocks B are arranged in the horizontal direction.

In each block B, the terminals 21,22 having the different sizes are disposed so as to be divided in the vertical direction. Namely, in each block B, the terminal 21 having a thick-size for a power supply system (hereinafter called "thick terminal") are disposed on the upper side, and the terminals 22 having a thin-size for a distribution system or signal transmission system (hereinafter called "thick terminal") are disposed on the lower side. Further, within the terminals 21,22 projecting from the rear wall of the connector housing 11, the thick terminals 21 are bent downwardly so as to form L-shape at an outer position with respect to the connector housing, and the thin terminals 22 are bent downwardly so as to form L-shape at an inner position with respect to the connector housing 11.

As described above, in the board connector 10 according to this embodiment, since the block B as one arrangement unit is formed by the group consisting of the terminals 21,22 having the different sizes, and the plurality of the blocks B are arranged in the horizontal direction, it is possible to reduce void spaces and increase the arrangement density. As a result, it is possible to achieve downsizing of the board connector 10.

Further, in the block B, since the terminals 21,22 having the different sizes are disposed so as to be divided in the vertical direction, the wiring availability to a conductive pattern (not-shown) on the printed circuit board K can be improved.

For example, according to this embodiment, the thick terminals 21 are disposed on the upper side and the thin terminals 22 are disposed on the lower side in each block B. In accordance with such arrangement, the projecting portions of the terminals 21,22 projecting from the rear wall of the connector housing 11 are bent downwardly so as to form L-shape while being kept in parallel with each other. Accordingly, conductor patterns having thick conductive portions to be connected with the thick terminals 21 can be disposed on an inner position with respect to the center of the board K and conductor patterns having thin conductive portions to be connected with the thin terminals 22 can be disposed on an outer position with respect to the center of the board K. Therefore, the conductor patterns having the thick conductive portions can be wired on the side of the center of the board K and are hardly interfered with the conductor patterns having the thin conductive portions, the wiring availability of the patterns on the board K can be improved.

Furthermore, since the thick terminals 21 are bent at the outer position with large dimension, the lengths of the terminals 21 are increased. Therefore, heat radiation property from the terminals 21 can be improved by increasing surface area of the terminals 21.

Furthermore, even though comparatively large force can be applied to the thick terminals 21 when the board connector and the mating connector are connected or disconnected with each other, the terminals 21 can be more flexible by increasing the terminal length and the distance between both fixing ends (the one end is fixed to the connector housing 11 and the other end is fixed to the board K). As a result, it is possible to avoid applying excessive force to the connection portion with the board K.

Figure 5:
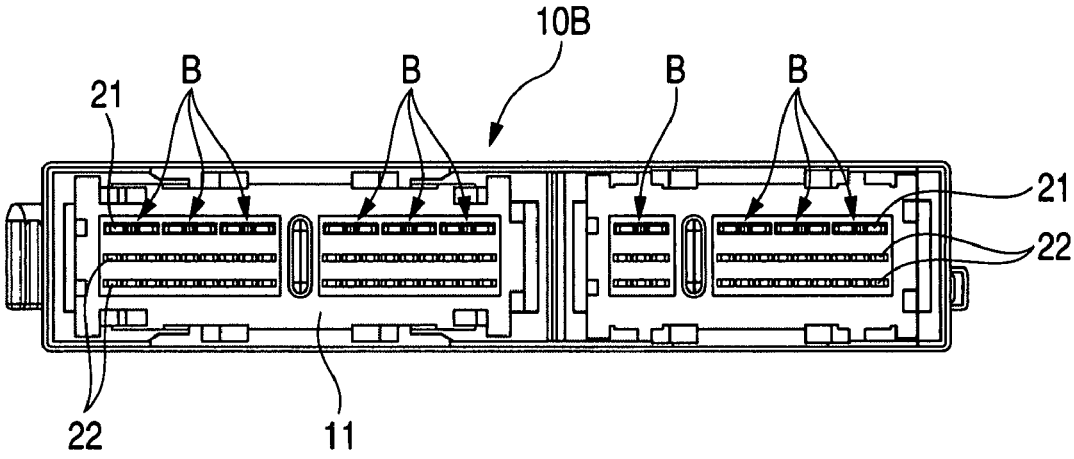
FIG. 5 is a front view of a second example of the board connector according to the embodiment of the invention.

The arrangement pattern of the blocks B can be selected arbitrarily so as to be the board connector 10 according to the first example as shown in FIG. 1 or so as to be the board connector 10B according to the second example as shown in FIG. 5.

The description will be made to comparison of the arrangement density of the terminals.

Figure 6:
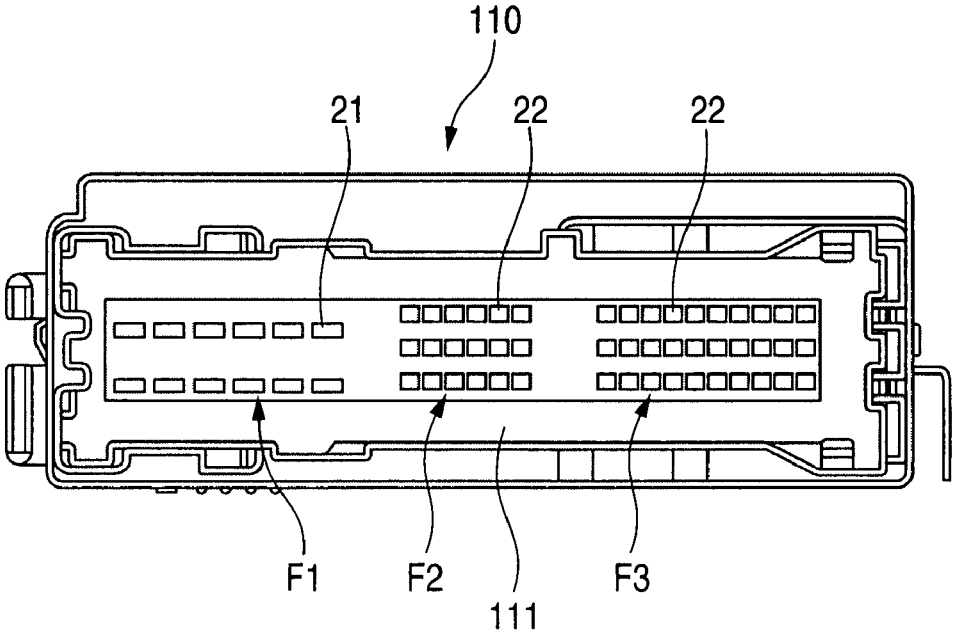
FIG. 6 is a front view of an example of a board connector for reference.

The board connector shown in FIG. 6 has the following specification. Incidentally, in the following specifications, the numbers in front of "Terminal" indicate types of the terminal based on the terminal width (mm)+For example, "2.5 Terminal" indicates the terminal whose terminal width is 2.5 mm.

| | |
|---|---|
| 2.5 Terminal (Thick terminal): | 12 terminals |
| 1.0 Terminal (Thin terminal): | 48 terminals |
| Total: | 60 terminals |
| Area of connector fitting face: | 20 $cm^2$ |
| Terminal Density: | 3.0 terminals/$cm^2$ |

The board connectors according to two examples of the invention as shown in FIGS. 1 and 5, have the following specifications.

In one block, power lines and signal lines are provided, the specification of each block is as follows:

1.5 Terminal (Thick terminal): 2 terminals (Power)

0.5 Terminal (Thin terminal): 6 terminals (Signal)

The first example shown in FIG. 1 has the following specification.

| | |
|---|---|
| 1.5 Terminal (Thick terminal): | 22 terminals |
| 0.64 Terminal (Thin terminal): | 68 terminals |
| Total: | 90 terminals |
| Area of connector fitting face: | 23 $cm^2$ |
| Terminal Density: | 3.9 terminals/$cm^2$ |

The second example shown in FIG. 5 has the following specification.

| | |
|---|---|
| 1.5 Terminal (Thick terminal): | 20 terminals |
| 0.5 Terminal (Thin terminal): | 60 terminals |
| Total: | 80 terminals |
| Area of connector fitting face: | 23 $cm^2$ |
| Terminal Density: | 3.5 terminals/$cm^2$ |

As described above, the connector can be downsized by increasing the terminal density.

The present invention is not limited to the above embodiment, and suitable modifications, improvements, etc., can be made. Furthermore, the material, shape, dimensions, numerical value, form, number, disposition, etc., of each of the constituent elements of the above embodiment are arbitrary, and are not limited in so far as the invention can be achieved.

For example, although the above embodiment is described with examples in which the terminals having two different sizes are arranged, the invention can be embodied by arranging terminals having three or more different sizes.

What is claimed is:

1. A board connector comprising:

a connector housing; and at least two types of terminals which have different sizes and are held in the connector housing;

wherein said at least two types of terminals are arranged along parallel lines in the connector housing and project from a rear wall of the connector housing and are bent in a downward direction to form an L-shape, wherein a plurality of blocks, each of which is formed by a group of said at least two types of terminals, are arranged in a horizontal direction, wherein only one type of terminal is provided on each parallel line in each block, and wherein the parallel lines are divided in a vertical direction in each block.

2. A board connector according to claim 1, wherein the terminals having a thick-size, which are a first one of said at least two types of terminals, are arranged on an upper side of the block, and the terminals having a thin-size, which are a second one of said at least two types of terminals, are arranged on a lower side of the block, and wherein the terminals having the thick-size are bent in a downward direction to form an L-shape at an outer position which is further from the connector housing than an inner position at which the terminals having the thin-size are bent.

3. A board connector according to claim 1, wherein the plurality of blocks are separated by a distance which is greater than a distance that separates terminals of the same type in each block.

* * * * *